US005725329A

United States Patent [19]

Chelminski

[11] Patent Number: 5,725,329

[45] Date of Patent: Mar. 10, 1998

[54] METHOD, SYSTEM AND APPARATUS FOR DRIVING AND PULLING PILINGS

[76] Inventor: Stephen Chelminski, 30 Danforth Rd., Rindge, N.H. 03461

[21] Appl. No.: 646,844

[22] Filed: May 8, 1996

[51] Int. Cl.[6] ..... E02D 7/02

[52] U.S. Cl. ..... 405/232; 173/1; 175/19; 405/228

[58] Field of Search ..... 405/232, 228, 405/245, 246, 247, 281; 175/19, 20; 173/49, 162.1

[56] References Cited

U.S. PATENT DOCUMENTS

| | | | |
|---|---|---|---|
| 3,714,789 | 2/1973 | Chelminski | 405/232 |
| 3,721,095 | 3/1973 | Chelminski | 175/19 X |
| 4,382,475 | 5/1983 | Suzuki | 173/162.1 X |
| 4,534,419 | 8/1985 | Vural | 173/1 |
| 5,088,564 | 2/1992 | Kobayashi | 173/1 |
| 5,168,939 | 12/1992 | Schroeder | 175/19 X |

FOREIGN PATENT DOCUMENTS

| | | | |
|---|---|---|---|
| 0298476 | 12/1990 | Japan | 173/1 |

*Primary Examiner*—Dennis L. Taylor

*Attorney, Agent, or Firm*—George W. Dishong

[57] ABSTRACT

A linear vibratory pile driver apparatus, system and method for using the apparatus to drive or to pull pilings. The apparatus is comprised of a lifting shaft isolated from but slideably mounted within a piston assembly which piston assembly is attached to a frame assembly. There is a cylinder assembly attached to a reaction mass and the piston assembly is vibratorily positioned within the cylinder assembly and vibratorily driven by hydraulic fluid at a selectable frequency thereby vibrating the piston/frame assembly (the piston assembly and the attached frame assembly) relative to the cylinder/reaction mass assembly (the cylinder assembly and the attached reaction mass). A clamp device such as jaws is attachable to a clamp-end of the frame assembly and the lifting shaft is attachable to a cable of a lifting apparatus such as a crane. The frequency of the vibration and the power of the vibration, which power is related to the pressure and the amount of hydraulic fluid and thus to the stroke length of the pistion, may be varied independently. By positioning the piston toward either the clamp-end or the cable end, and by adjusting the power, i.e., the stroke length, the linear vibratory pile driver may function as a hammer and a vibrator concurrently. Lowering the frequency of the vibrations and with the position of the piston toward one end or the other will result in the apparatus functioning as a hammer for either driving or pulling a pile.

20 Claims, 6 Drawing Sheets

METHOD, SYSTEM AND APPARATUS FOR DRIVING AND PULLING PILINGS

BACKGROUND OF THE INVENTION

1. Field of the Invention

The present invention is in the field of pile driving and pulling. More particularly, the invention relates to a method, system and apparatus for driving and pulling pilings utilizing intense vibrations. The method, system and apparatus allows the operator to drive pilings using a linear hydraulic vibrator supplied with hydraulic fluid at high pressure from a high pressure, large volume, hydraulic pump through suitable hydraulic hoses. The pile driving system may be "tuned" to take into consideration soil conditions and site requirements to obtain a high degree of driving efficiency, utilizing vibration sensing pickup units on the ground and/or on the pile driving system apparatus to feed information of driving frequency and driving rate to an electronic control unit which controls the vibration frequency of the pile driving apparatus.

2. Description of the Prior Art

The use of machines for driving elements into the ground has widespread applications in the formation of foundations for structures of all types, the elements which can be driven into the ground may vary in shape depending upon the particular purpose.

Pile driving has traditionally been done using hammers powered by steam, compressed air, or hydraulic power and more recently methods using vibrations have been employed. It has been found that when a pile is subjected to intense linear vibrations along the axis of the pile, and when the weight of the vibratory pile driver apparatus is added to the weight of the pile, (usually a steel pile), and where the soil conditions are suitable for this method of pile driving, the rate of penetration is most frequently found to be considerably faster than would be obtained using hammer methods and apparatus.

The conventional rotary vibratory pile driver has a heavy housing provided with at least two shafts which carry eccentric weights. Typically, slugs of heavy metal are set, off-center, into gears. Other eccentric mass rotors are also used. The weight of the eccentric masses are typically measured in tens or hundreds of pounds as compared to the weight of the mass of the remaining frame and support system of rotary vibratory drivers being measured thousands of pounds. Thus there is an inherent disfavor against the reaction mass, i.e., the eccentric rotor weights, which may be as high as about 1 to 10. I.e., the ratio of the weight of the reaction mass to the mass being vibrated should preferably be greater than one.

The shafts of the rotary vibrator are rotated at high speed, typically 1200 rpm (20 Hz), thereby vibrating the housing assembly which is clamped to the pile to be driven or set. This vibration, combined with the weight of the driver, causes the pile to sink into the ground or conversely pulled out of the ground when tension is applied by use of a crane or like machine. Typically, the housing is suspended from the cable of a crane by means of an elastomeric vibration damper so that the vibration is transferred to the pile and not back up the cable to the crane. These known vibratory drivers cannot be used to both hammer and vibrate.

The rotary vibratory type of pile drivers have the disadvantages of generating the linear vibrations to the pile by using heavy eccentric weighted masses which must be rotated synchronously using a substantial amount of energy to do so. There are inherent inefficiencies related to the conversion of the rotational energy to linear vibratory energy. To vary the frequency of the linear vibrations, the synchronous rotary speed of the eccentric masses must be altered at a substantial energy cost and because of the size of the masses being driven into sychronous rotation, there is substantial inertia to overcome when either increasing the frequency or decreasing the frequency. The rotary units need to be "run up" through a range of frequencies to arrive at the desired frequency. When they "run up" as they are put into use, they may run thru frequencies which could momentarily damage sensitive nearby structures. These pile drivers also have an ideal speed of rotation and consequently an ideal frequency of vibration. Lower frequency requires less hydraulic fluid to the hydraulic motors driving the eccentric rotors. With the lowering of frequency and less hydraulic fluid there is produced a corresponding lower energy output. Increasing the frequency results in an increased flow of hydraulic fluid from the power supply and an increased risk of gear and bearing wear or burn-out.

The following is a brief description and discussion of patents defining the most closely related inventions.

U.S. Pat. No. 5,088,565, "Vibratory Pile Driver" to Evarts, Kingsley S., Issued Feb. 18, 1992 discloses a vibratory pile driver having a clamping means for clamping onto a pile, hydraulic gear motor having two oppositely rotatable shafts and a pair of semicircular weights aligned in the same vertical plane and each is secured to a shaft parallel to the motor shafts. There are drive and driven pulleys, sprockets or the like connected by toothed timing belts, chains or the like for driving the weights synchronously.

U.S. Pat. No. 4,625,811, "Hydraulic Vibratory Pile Driver" to Tuenkers, Josef-Gerhard, Issued Dec. 2, 1986 discloses a vibratory pile driver with a rigid housing, a pair of parallel and horizontally spaced shafts journaled for rotation wholly independently of each other about respective parallel and horizontally spaced axes in the housing, respective generally equally massive and eccentrically mounted weights on the shafts, respective hydraulic drive motors on the housing connected to the shafts for oppositely rotating the shafts and the weights.

U.S. Pat. No. 4,819,740, "Vibratory Hammer/Extractor" to Warrington, Don C., Issued Apr. 11, 1989 discloses a vibratory hammer/extractor for use with elongated pilings and the like. The vibratory exciter includes, among other elements, one pair of eccentric weights mounted on shafts for rotation about an axis transversely of the clamped piling for imparting vibratory forces to the piling as the eccentrics are driven in rotation.

Clearly, none of these Patents disclose the invention taught and claimed herein.

Applicant has some familiarity with seismic vibrators which operate without the use of rotary eccentric masses. The seismic vibrators are useful for imparting vibration energy into the earth but have no use in the field of construction and particularly in the field of driving and extracting pilings.

It would be desirable to have a vibratory pile driver apparatus, system and method for driving pilings which overcomes many of the deficiencies and disadvantages of the prior art pile drivers. The present invention disclosed and claimed herein has the particular objectives, features and advantages of: 1) a low height, which is advantageous for application under bridges and in buildings; 2) producing a linear vibration without the need to convert from rotary motion to linear motion; 3) compatibility with a wide range of power units, from about 50 to 300 gpm; 4) providing a constant level of energy over a wide range of frequencies; 5) capable of rapid and simple control of a wide range of frequencies; 6) may be started at a set frequency, particularly advantageous where sensitive nearby structures can be damaged by certain frequencies; 7) may be used for jarring or hammering up or down while vibrating; and 8) having a reaction mass to vibratory load ratio substantially greater than one (1), i.e., having the reaction mass being substantially heavier than the vibratory load rather than ratio of reaction mass to vibratory load ratio being substantially less than one (1), i.e., the vibratory load being substantially heavier than the reaction mass.

SUMMARY OF THE INVENTION

Basically the present invention in its most simple form or embodiment is directed to a linear vibratory pile driver apparatus and the method for using the apparatus to drive or to pull pilings. The apparatus is comprised of a lifting shaft isolated from but slideably mounted within a piston assembly which is attached to a frame assembly, a cylinder assembly attached to a reaction mass, the piston assembly is vibratorily positioned within the cylinder assembly and vibratorily driven by hydraulic fluid at a selectable frequency thereby vibrating the piston/frame assembly (the piston assembly and the attached frame assembly) relative to the cylinder/reaction mass assembly (the cylinder assembly and the attached reaction mass). A clamp device is attachable to a clamp-end of the frame assembly and the lifting shaft is attachable to a cable of a lifting apparatus such as a crane. Collectively, the piston/frame assembly and the cylinder/reaction mass assembly may be referred to as the vibratory assembly.

The frequency of the vibration and the power of the vibration, which power is related to the stroke length of the piston, i.e., the vibration amplitude, may be varied independently. By positioning the piston toward either the clamp-end or the cable end, and by adjusting the power, i.e., the stroke length, the linear vibratory pile driver may function as a hammer and a vibrator concurrently. Lowering the frequency of the vibrations and with the position of the piston toward one end or the other will result in the apparatus functioning as a hammer for either driving or pulling a pile.

It is a primary object of the present invention to provide a linear vibratory pile driver apparatus to drive and to pull pilings comprising: a lifting shaft vibration isolated from, but slideably mounted within, a piston assembly. The piston assembly is attached to a frame assembly and the frame assembly restricts sliding movement of the lifting shaft within the piston assembly. A means for vibration isolating (a vibration isolator) the lifting shaft from the piston assembly is positioned within the inside cavity of the piston assembly. The vibration isolator acts to dampen or isolate the vibration of the piston and frame assembly from the lifting shaft and further limits sliding movement of the lifting shaft within the piston inside cavity. A cylinder assembly is attached to a reaction mass and the piston assembly is vibratorily positioned within the cylinder assembly. There is also a means for vibratorily driving the piston assembly by hydraulic fluid at a selectable frequency thereby vibrating the piston assembly and the attached frame assembly, i.e., the piston/frame assembly relative to the cylinder assembly attached to the reaction mass assembly, i.e., the cylinder/mass assembly.

It is another primary object of the present invention to provide a linear vibratory pile driver apparatus to drive and to pull pilings comprising: means for vibration isolating the cable from vibration of the pile driver. The means for isolating also limits movement of the lifting shaft relative to a vibratory assembly. The vibratory assembly comprises: a piston assembled and positioned concentrically around and in sliding association with the lifting shaft; a piston ring member extending radially from an outer surface of the piston; a frame assembly rigidly affixed to the piston. The frame assembly has a cable-end member, a clamp-end member and at least one connecting member connecting the cable-end member and the clamp-end member of the frame assembly. The frame cable-end member and the clamp-end member each cooperate with the means for isolating the cable and each are configured to limit sliding movement of the lifting shaft. The clamp-end attaches to the means for clamping (jaws). Further there is a reaction mass which has a cylinder wall member configured and assembled concentrically around and in sliding association with the piston. The cylinder wall member to define, in combination with the piston and the piston ring member a cylinder head cavity with two portions, a cylinder head cable-end cavity and a cylinder head clamp-end cavity. The linear vibratory pile driver further comprising: means for providing fluid into the cylinder head cavity; and means for relative pressurizing at a determined and controlled frequency, each the cylinder head cable-end cavity and the cylinder head clamp-end cavity relative each to the other.

It is another primary object of the present invention to provide the linear vibratory pile driver apparatus as above where there may also be provided combination of the additional elements such as 1) a plurality of means for fluid-tight sealing of the fluid within the cylinder head cavity between the sliding association of the cylinder wall member and the piston; 2) a plurality of cylinder wall member bearing devices to make substantially frictionless the sliding association of the cylinder wall member and the piston; 3) a plurality of lifting shaft bearing devices to make substantially frictionless the sliding association of the piston with the lifting shaft; 4) means for indicating a position of the valve spool member within the spool valve; 5) means for determining location of the reaction mass relative to the frame assembly; 6) means for controllably varying the determined and controlled frequency of the relative pressurizing; and 7) means for controlling a magnitude of pressure of the fluid into the cylinder head cavity.

It is yet another primary object of the present invention to provide the linear vibratory pile driver apparatus as above wherein the piston ring member extends radially from an outer surface of the piston and may be substantially at an axial mid-point of the piston and wherein the means for isolating is a form of spring or springs such as dished washers, compression springs and elastomers. The means for providing fluid into the cylinder head cavity comprises: 1) at least one cable-end fluid port in fluid flow communication with the cylinder head cable-end cavity and in fluid flow communication with at least one first fluid channel; 2) at least one clamp-end fluid port in fluid flow communication with the cylinder head clamp-end cavity and in fluid flow communication with at least one second fluid channel. The means for relative pressurizing at a determined and controlled frequency, both the cylinder head cable-end cavity and the cylinder head clamp-end cavity relative each to the other comprises preferably a spool valve having a valve spool member and a spool controller; 3) a manifold block positioned adjacent to the spool valve to provide the proper porting configuration between each of the first fluid channels and each of the second fluid channel; 4) at least one bumper pad fixedly attached to the frame clamp-end member; 5) at least one bumper pad fixedly attached to the frame cable-end member for protecting the frame assembly from said reaction mass; and 6) a bumper cushion disposed between the lifting shaft clamp end and the frame clamp-end member.

It is still another primary object of the present invention to provide a method of driving a pile using the linear vibratory pile driver as above described. The method comprises the steps of: attaching and suspending, at a cable-end, the linear vibratory pile driver to a cable of a crane; clamping a pile between gripper jaws at a clamp-end of the pile driver; placing the pile where it is to be driven; providing means for isolating the cable from vibration of the pile driver; imparting linear vibration to the pile, at the clamp-end by means of a vibratory assembly. The vibratory assembly comprises: a piston portion positioned concentrically around and in sliding association with a means for attaching and suspending the pile driver, the piston portion having a piston ring member; a frame rigidly affixed to the piston, the frame having a cable-end member, a clamp-end member and at least one connecting member connecting the cable-end member and the clamp-end member. The cable-end member and the clamp-end member each cooperate with the means for isolating the cable and each configured to limit sliding movement of the means for attaching and suspending. The clamp-end is attachable to the means for clamping. A reaction mass is positioned concentrically around and in sliding association with the piston portion and the reaction mass has a cylinder wall member configured to define, in combination with the piston ring a cylinder cavity having a cylinder cable-end cavity and a cylinder clamp-end cavity. Each of the cable-end cavity and clamp-end cavity are in fluid flow communication with a source of pressurized fluid and a means for cyclically providing each of the cylinder cable-end cavity and cylinder clamp-end cavity with pressurized fluid. The pressurized fluid is provided into the cylinder head cavity. Each of the cavities is cyclically pressurized relative to each other at a predetermined frequency. The frequency of relative pressurizing is controllable frequency. The magnitude of relative pressure is also controllable independent of the controlled frequency and without effecting the controlled frequency.

It is a further primary object of the present invention to provide the method of driving and pulling pilings as above wherein the following additional steps may be provided: 1) implanting at least one transducer in the ground; and 2) controlling the frequency of the vibration of the pile by integrating, in an electronic control unit, the output from each of the transducers implanted in the ground and the output from each of the transducers attached to the pile driver.

These and further objects of the present invention will become apparent to those skilled in the art after a study of the present disclosure of the invention and with reference to the accompanying drawings which are a part hereof, wherein like numerals refer to like parts throughout, and in which:

DESCRIPTION OF THE PREFERRED EMBODIMENTS

Figure 1:
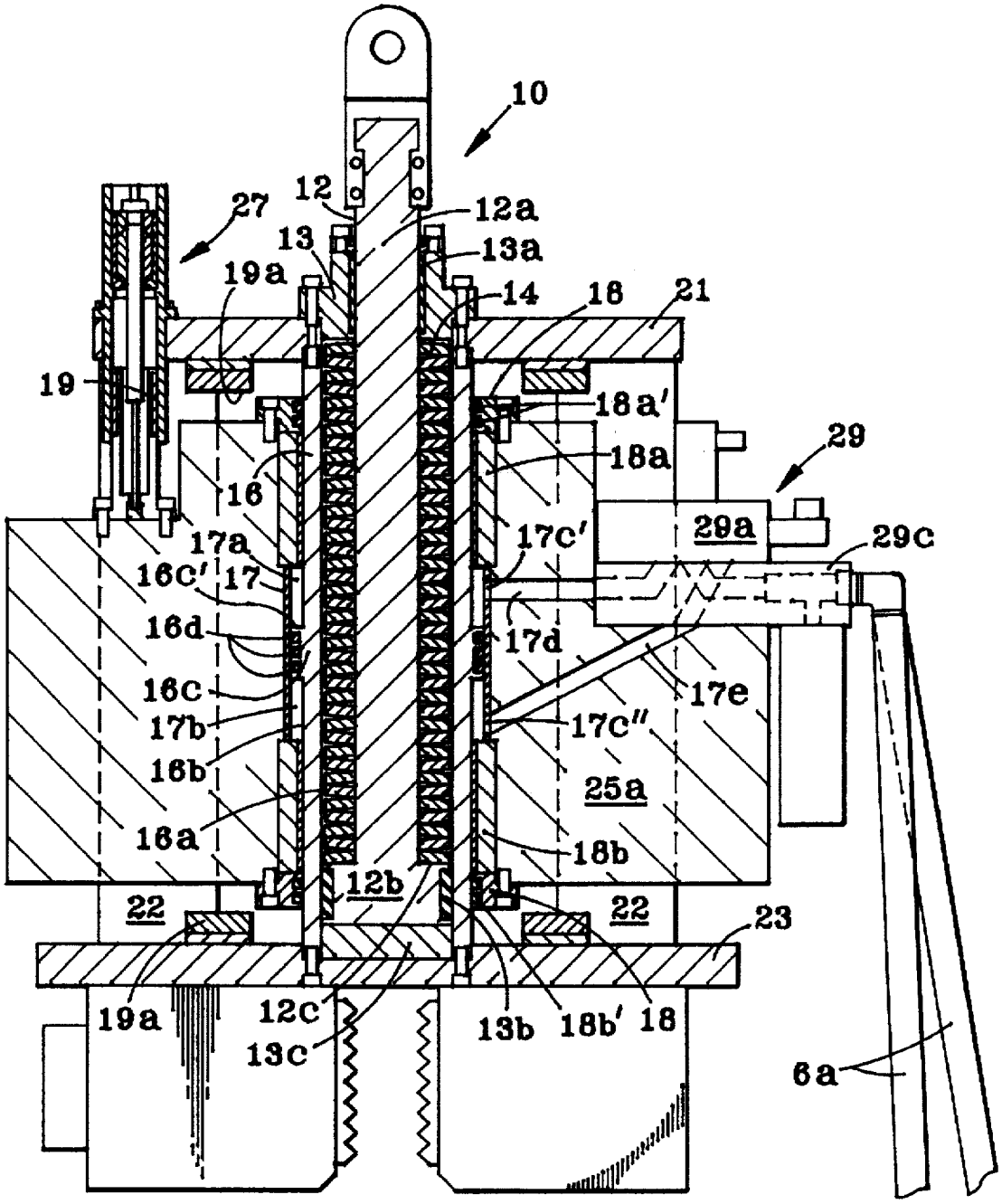
FIG. 1 is a front partial section view showing concentric relationship of piston, isolator, cylinder, cylinder cavity, piston rings, seals and bearings.
Figure 2:
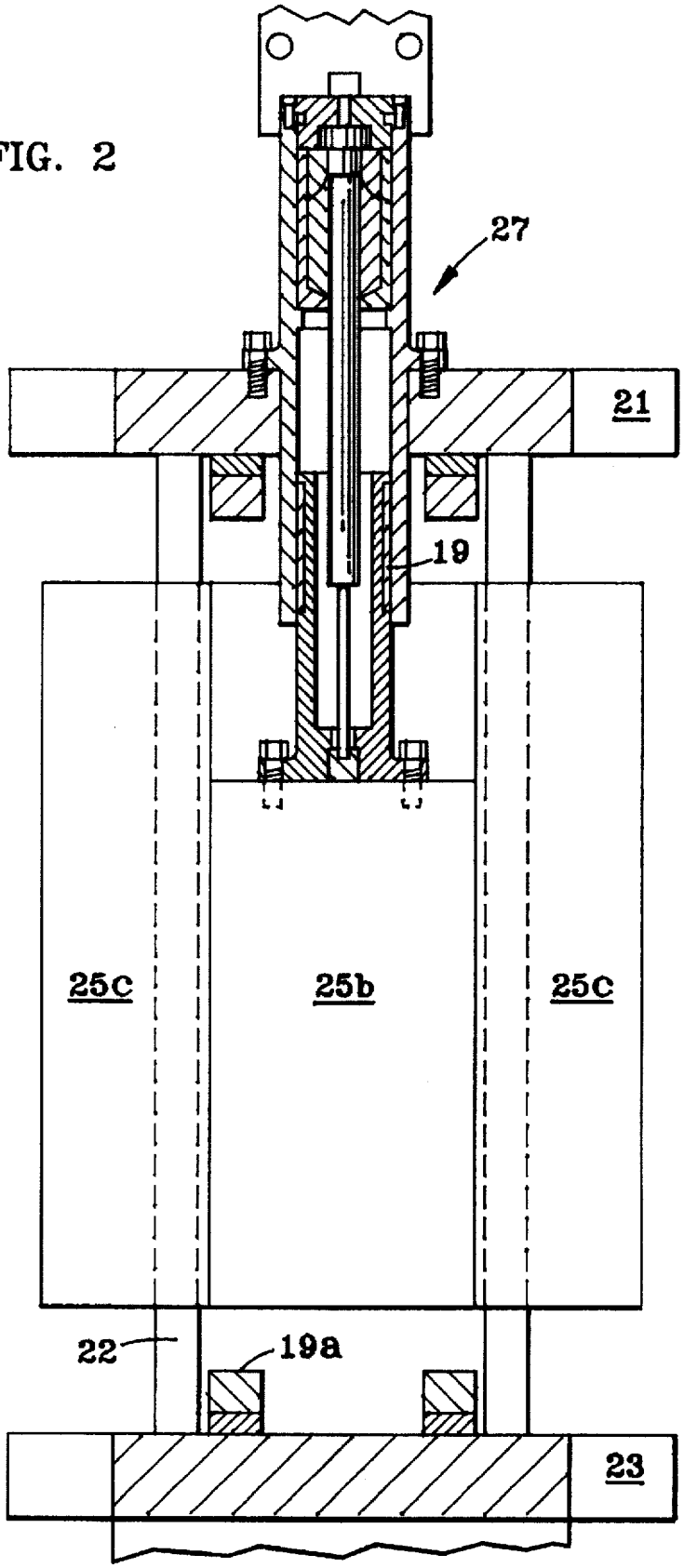
FIG. 2 is a partial left side view of the device of FIG. 1 showing reaction mass position indicator attachment in cross section along with mass/frame slide alignment bearing.
Figure 3:
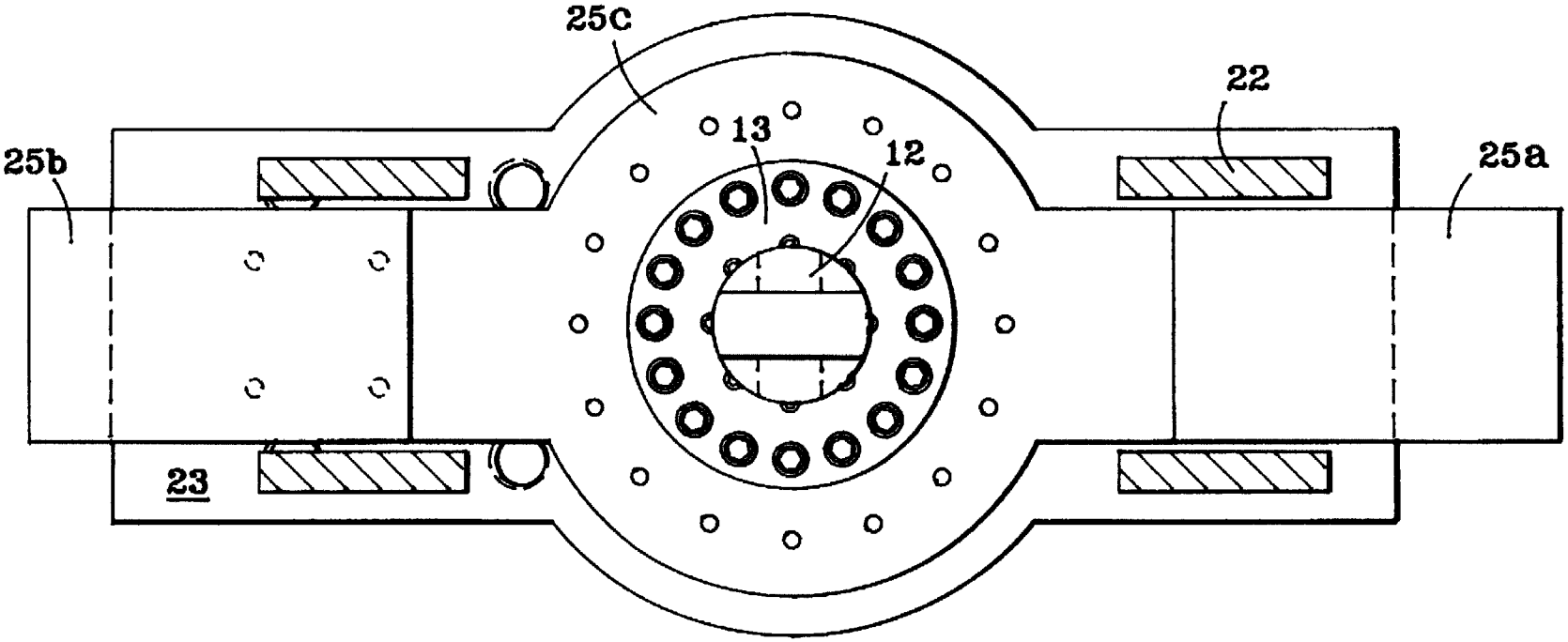
FIG. 3 is a top partial view showing some of the bolt patterns needed for assembly of the pile driver, the cable-end frame member is not shown so as to improve clarity.

The construction and the design of the linear vibratory pile driver 10 will be described with reference to FIGS. 1–6 collectively. Clearly, it is obvious that many sizes, power capabilities and forms and varieties of geometric configurations of the various basic parts of the pile driver such as the shape of the reaction mass, the shape of the frame assembly (the frame connecting members could be rods instead of plates of material) and the surface geometry may be used. However, the basic structure of the apparatus and the basic method of using the apparatus remains the same and the objectives and the advantages are clearly, lower cost, lower maintenance, more effective and efficient, constant vibratory power at different frequencies, an advantageous greater than one ratio of reaction mass to frame mass and no rotory eccentric rotors.

Linear Vibratory Pile Driver Apparatus

The linear vibratory pile driver 10 is comprised of two fundamental and basic assemblies—a lifting assembly, and a vibrator assembly. The two ends of driver 10 are designated as the cable-end and the clamp-end. The driver cable-end is the end of the driver attachable to the cable 3 of a crane 2. The driver clamp-end is the end of the driver attachable to a piling 9 to be driven or pulled. Cylinder/reaction mass assembly 50, during operation, is stable relative to piston/frame assembly 40 and consequently pile 9, if attached by jaws 23*a*, is caused to vibrate.

Generally, for linear vibratory pile driver 10, lifting shaft 12 is within piston 16, piston ring portion 16*c* is within cylinder member 17 (preferably a machined sleeve 17 which inner wall 17*c* cooperates with piston rings 16*d* to create a seal) which is within a reaction mass central portion 25*c*. Frame 20 is connected to piston 16 at both the cable end and the clamp end. Cylinder 17 is positioned within or connected to reaction mass central portion 25*c*. Toward the cable end and around piston 16 is piston/cylinder cable-end bearing 18*a* and toward the clamp end and around piston 16 is piston/cylinder clamp-end beating 18*b* Piston/reaction mass bearing and seal retainers 18 keeps bearings 18*a* and 18*b* positioned within mass 25 and against cylinder sleeve 17 thereby keeping cylinder 17 positioned within mass 25 at both the cable end and the clamp end. Reaction mass first side member 25*a* and second side member 25*b* lie within frame 20. Located on and within reaction mass first side member 25*a* is means 29 for relative pressurizing at a determined and controlled frequency including means for providing fluid to each cylinder cable-end cavity 17*a* and cylinder clamp-end cavity 17*b* relative each to the other. I.e., the fluid under pressure is frequency controllably alternated between cable-end fluid conduit 17*d* to cable-end port 17*c*' and clamp-end fluid conduit 17*e* to clamp-end port 17*c*", i.e., the means for providing fluid to each cylinder. Means 29 is preferably a spool valve 29a and a manifold block 29b, and is attachable to reaction mass 25.

The lifting assembly is made up of a lifting shaft 12 having a lifting shaft cable-end 12a, a lifting shaft middle portion and a lifting shaft clamp-end 12b. Lifting shaft clamp-end 12b is configured with a flange portion below which may be a cushion pad 13c and on the flange surface rests a clamp-end of vibration isolator 14. Vibration isolator 14 also limits the movement of lifting shaft 12 within a piston inner cavity defined by piston inner wall 16a because the cable-end of isolator 14 is retained by isolator and lifting shaft cable-end bearing retainer 13 which is attached to frame cable-end member 21. Isolator 14 is further held in place by a cable-end frame member 21 and a clamp-end frame member 23 in addition to piston inner wall 16a. Vibration isolator 14, which may be dished washers, compression springs an elastomer material, gas springs or any other material suitable for the purpose of vibration isolating. There is a lifting shaft cable-end bearing or bushing 13a and a lifting shaft clamp-end bushing 13b. These beating or bushings permit the smooth movement of lifting shaft 12 relative to clamp-end of piston 16 and a lifting shaft cable-end bearing retainer and isolator retainer 13.

Vibrator assembly is comprised of piston 16 attached to a frame assembly 20, and a cylinder assembly or member 17 which cylinder member 17 is attached to or held within reaction mass 25. The piston/frame assembly 40 is in slideable relation with cylinder/reaction mass assembly 50. Lifting shaft 10 of the lifting assembly is contained substantially within piston 16 and in slideable relation with piston 16. There is also means for vibratorily driving piston/frame assembly 40, by hydraulic fluid, at a selectable frequency thereby vibrating piston/frame assembly 40 relative to cylinder/reaction mass assembly 50. Such mean for vibratorily driving includes piston ring portion 16c, rings 16d, cylinder cavities 17a and 17b, fluid ports 17c' and 17c", conduits 17d and 17e and means 29 for relative pressurizing at a determined and controlled frequency.

Lifting Assembly

In the present and preferred embodiment of the invention, lifting assembly comprises a lifting shaft 12 which is preferably in the form of a rod. Lifting shaft 12 has a cable-end portion 12a, a middle portion, and a clamp-end portion 12b. Clamp-end portion 12b has a diameter which is less than the inside diameter of piston 16 preferably by an amount which permits use of lifting shaft clamp-end bearing 13c. The lifting shaft middle portion and cable-end portion have a diameter around which will fit isolator 14 and isolator 14 has an outer diameter which fits inside the inner cavity of piston 16. Cable-end portion 12a may be fitted with a bale which connects to a lifting cable 3 of a crane 2. Lifting shaft 12 is fitted within the inner cavity of piston 16 on top of a cushion pad 13c. Cushion pad 13c rests on or is attached to a clamp-end frame member 23. On the lifting shaft clamp-end portion 12b there is a flange 12c. On a surface of flange 12c opposed from the surface on which lifting shaft 12 rests on cushion pad 13c there rests concentrically configured vibration isolator 14 which isolator 14 is sufficiently long to reach the lifting shaft cable-end portion 12a. A lifting shaft retainer 13 is attached to cable-end frame member 21. Lifting shaft retainer 13 also limits the movement or excursion of lifting shaft 12 relative to frame 20. Preferably, a cable-end and a clamp-end bearing or bushing 13a and 13b respectively is provided to reduce sliding friction between lifting shaft cable-end portion 12a and frame 20 and between clamp-end portion 12b and piston inner wall 16a defining the lifting shaft/isolator cavity i.e., the inner cavity of piston 16.

Vibration isolator 14 in the preferred embodiment as shown, utilizes dished spring washers which start to flatten out when strain is put on lifting cable 3 from crane 2 thus acting as a spring to lessen the amplitude of vibration going from pile driver apparatus 10 up cable 3 to crane 2. To give isolator 14 a broader spring range, some of the disc springs may be thicker than others, the thinner ones flattening out first and the thicker ones taking over as more strain is exerted by hoisting cable 3. The spring members instead of dished spring washers may be made from an elastomer such as synthetic rubber or polyurethane as a yet different embodiment, the spring member may be a gas spring or any other suitable form of compression spring.

Vibrator Assembly

Piston Assembly

Piston 16 of piston assembly is preferably a thick walled tube. Within the inner cavity of piston 16 is located lifting shaft 12, the bushings 13a and 13b and cushion pad 13c along with isolator 14. In the present preferred embodiment there is a piston ring portion 16c about centrally located between the cable-end and the clamp-end of the piston 16 and which extends radially outward from the outer wall 16b of piston 16. At least one means for sealing but preferably a plurality of piston rings 16d are attachable to piston ting portion 16c. Piston 16 is attached to frame assembly 20 at cable-end frame member 21 and at clamp-end frame member 23. Piston ting portion 16c also defines a piston ting cable-end cavity wall 16c' and a piston ring clamp-end cavity wall 16c". These cavity walls 16c' and 16c" define, along with other defining walls, cylinder head cable-end cavity 17a and cylinder head clamp-end cavity 17b.

Cylinder Assembly

The cylinder assembly comprises a cylinder 17 having an inner cylinder wall 17c. Cylinder 17 is attached to and concentrically located inside reaction mass 25, particularly inside of reaction mass center portion 25c and the piston assembly is vibratorily positioned within cylinder assembly 17. Cylinder inner wall 17c cooperates with piston outer wall 16b, piston ring portion 16c and the surfaces or walls of the piston ring portion, cable-end cavity wall 16c' and 16c" and one end of piston/reaction mass cable-end beating 18a and one end of piston/reaction mass clamp-end bearing 18b to define respectively cylinder cable-end cavity 17a and cylinder clamp-end cavity 17b. Cable-end fluid port 17c' and clamp-end fluid port each respectively admit fluid into cavity 17a and 17b which fluid is provided via a cable-end fluid conduit 17d and a clamp-end fluid conduit 17e the fluid conduit being within reaction mass 25 and particularly reaction mass first side member 25a. The cylinder attached to the reaction mass forms cylinder/reaction mass assembly 50.

Piston/reaction mass cable-end seal 18a', and piston/reaction mass clamp-end seal 18b' provide a means for sealing cavities 17a and 17b preventing the loss of pressurized fluid from these cavities when the apparatus 10 is operating. Each of the bearings and seals 18a, 18a' and 18b, 18b' are held in place by retainer 18 which is attachable to cylinder/reaction mass assembly 50.

Frame Assembly

Frame 20 is attached to piston 16 at both the cable-end and the clamp-end. Frame cable-end member 21 attaches to the cable end of piston 16 and frame clamp-end member 23 attaches to the clamp-end of piston 16. Between frame members 21 and 23 is frame connecting member 22. In the embodiment illustrated in FIGS. 1–3 connecting member 22 is shown in the form of a plate. There are four (4) such plates connecting frame members 21 and 23. Between the plates is reaction mass 25. On a first side of apparatus 10 is reaction mass first side member 25a which lies between two (2) of the plates 22. On a second side of apparatus 10 is reaction mass second side member 25b which lies between two (2) of the plates 22. Alignment bearing 19, shown in FIG. 3, may be provided to keep aligned the parts of means 27 for indicating reaction mass location since means 27 connects between reaction mass second side member 25b and frame cable-end member 21. This bearing 19 keeps the reaction mass 25 aligned between frame connecting member plates 22 or rods 22a particularly so that a means 27, when used, will remain properly aligned and functioning.

Figure 4:
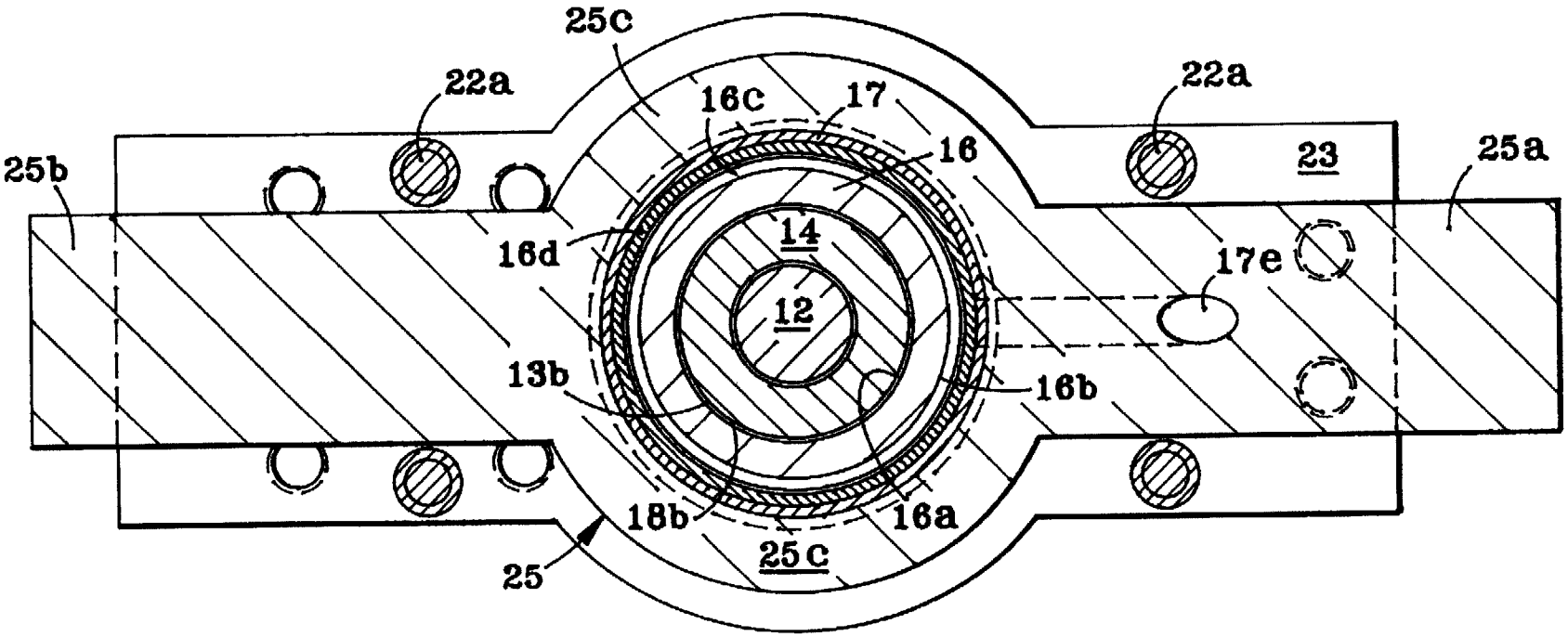
FIG. 4 is a top section view of an alternate embodiment using rods as the frame connecting members but having the same concentric relationship between elements.
Figure 5:
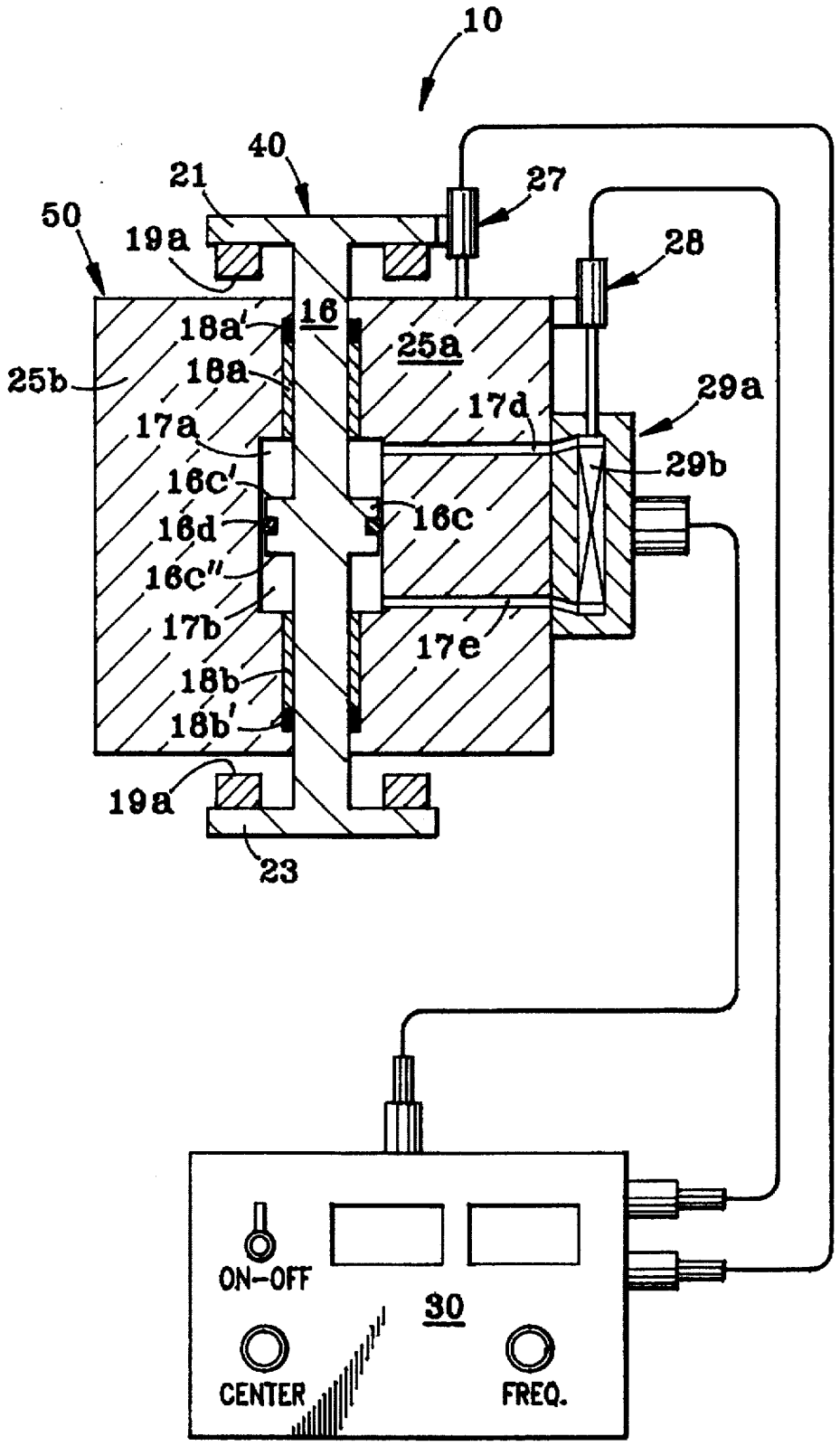
FIG. 5 is a schematic sketch of the spool valve and valve spool member along with the spool valve position sensor and the control box.

The frame connecting members may have other forms such as rods 22a as illustrated in FIG. 4. Preferably at least four frame connecting member rods 22a would be used. Alignment of reaction mass 25 relative to frame 20 would be maintained using similar type bearings as bearings 19.

Linear Vibratory Pile Driver System and Method of Use

Hydraulic power is supplied to the pile driver by hydraulic power unit 6 by way of hydraulic power supply and return lines 6a. Hydraulic power supply and return lines 6a are connected to manifold block 29c which is positioned relative to servo valve/spool valve 29a to provide the proper configuration for alternating/switching the relative pressure between the input hydraulic fluid conduits 17d and 17e formed in reaction mass 25.

The servo valve/spool valve 29a cyclically alternates the application of hydraulic pressure to cylinder cable-end cavity 17a causing movement of piston/frame assembly 40 downward toward clamp-end and then the application of hydraulic pressure to cylinder cable-end cavity 17b causing movement of piston/frame assembly 40 upward toward cable-end, thus causing piston/frame assembly 40 to vibrate relative to cylinder/reaction mass assembly 50. The rate of the cyclic application of hydraulic pressure is preferably controlled by controlling servo valve 29a through signals transmitted from operator control 30 by a control cable attached to servo valve 29a. Preferably, the hydraulic fluid passes to cable-end and clamp-end cavities 17a and 17b respectively through cable-end fluid conduit 17d and clamp-end fluid conduit 17e formed in the reaction mass 25.

It is important to note that the relative difference of the hydraulic fluid pressure within cavities 17a and 17b is substantially independent of the frequency of the vibration. Thus power and frequency are controllable independent of each other.

Figure 6:
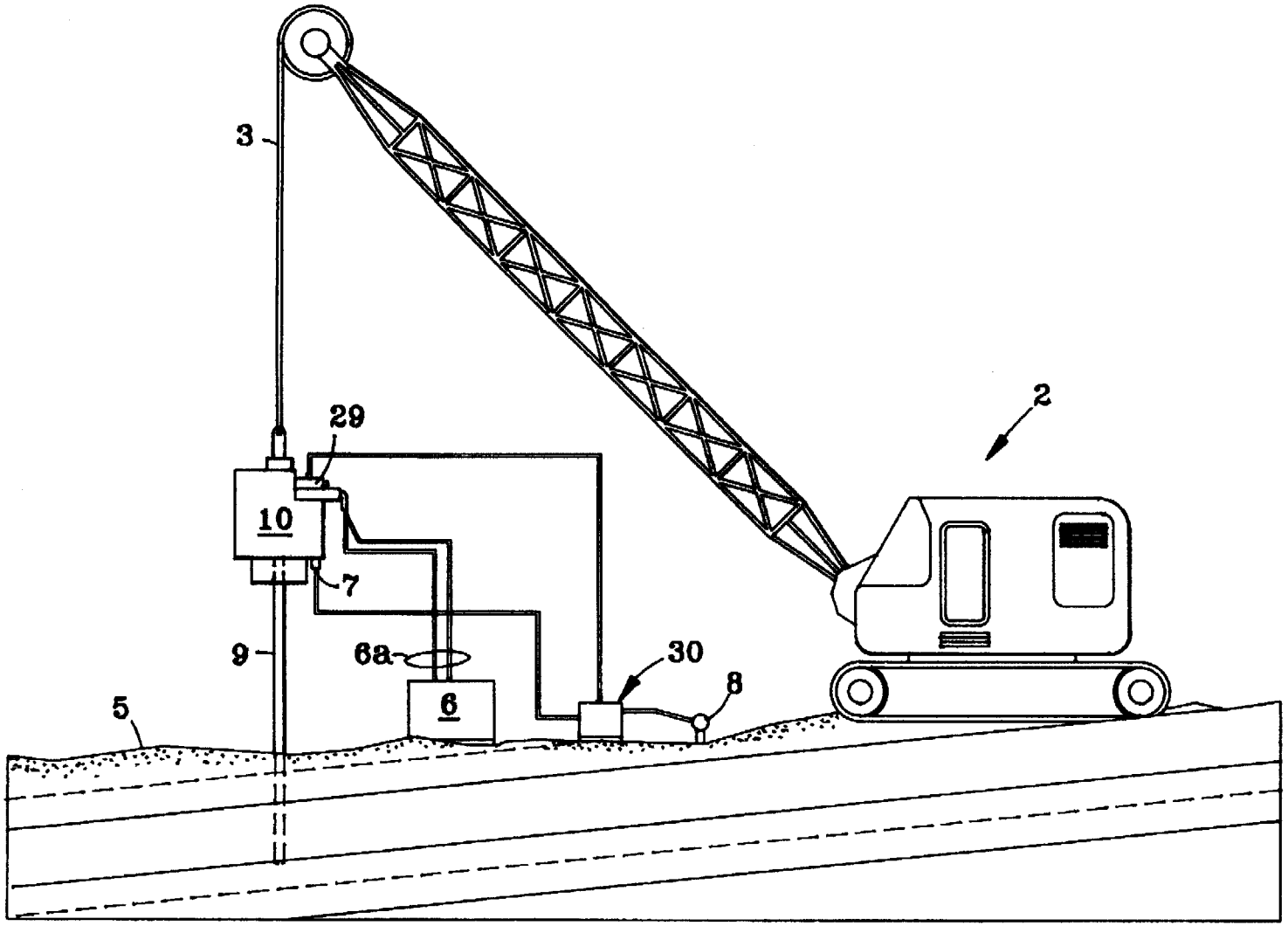
FIG. 6 is a sketch representing the linear vibratory pile driver in use attached to a cable of a crane, a pile attached to the driver and a hydraulic power unit along with vibration sensors and control of the driver based upon input from the sensors.

FIG. 6 illustrates pile driver 10 connected to a crane 2 by hoisting cable 3. As discussed above, hoisting cable 3 is attachable to the lifting bale which is attachable to lifting shaft 12. The hydraulic power unit 6 is connected to pile driver 10 by hydraulic power supply and return lines 6a. Means for operator control 30 (control box 30) of driver 10 is shown to include as inputs, a vibration sensing transducer 7 affixed to pile driver 10 and a vibration sensing transducer 8 implanted in ground 5. Control cables communicate the control signal from control box 30 to means 29 for frequency controlling the vibration of driver 10.

To drive a pile using the present invention, the following steps may be followed. Pile 9 should be gripped between the gripper jaws 23a. Highly pressurized hydraulic fluid from a hydraulic power supply 6 should be supplied from hydraulic power unit 6 through hydraulic power supply and return lines 6a to servo valve 29a. Pile 9 should be placed in the location where it is to be driven. Pile 9 should then be vibrated using linear vibratory pile driver apparatus 10 at a predetermined and selected frequency and power.

The method of the present invention may also include the step of adjusting the frequency of vibration by adjusting the frequency control of servo valve 29a using control means 30. Further, the method may also include attaching at least one vibration sensing transducer 7 to pile driver 10 and monitoring the frequency of the vibration. Additionally, the method may include implanting at least one vibration sensing transducer 8 in ground 5 and monitoring the frequency of the vibrations transmitted through the ground. Or transducer 8 may be place on nearby structures for the purpose of monitoring the vibrations transmitted in the ground by the pile driving process. The sensing of these vibrations is essential to the ability of the operator to "tune out" those frequencies which may resonate the surrounding ground in a harmful way without impeding the progress of the pile driving operation.

Preferably, when vibration sensing transducers 7 and 8 are employed, the vibration rate of pile driver apparatus 10 and consequently the vibration of pile 9 may be automatically controlled by using the output of transducers and using or integrating this output to determine optimum frequency and power.

Vibration sensing transducers 7 and 8 may be accelerometers. The frequency of vibration and the progression of the pile may be both monitored and controlled by control means/box 30.

Control device 30 is employed so that the operator may start, stop and control the vibration frequency of pile driver apparatus 10 at will. Also, control box 30 may be programmed to seek the ideal vibration frequency for the apparatus to run at, depending on the soil and site conditions. The optimal driving frequency may be employed and undesireable frequencies may be excluded.

Within certain constraints, unit 6 is a "constant" power vibratory pile driving power source. I.e. at a given power unit pressure, where the frequency of vibration is lowered as controlled by electronic control unit 30, the amplitude (distance traveled by each stroke of the vibration) increases. When the frequency is raised, the amplitude of each vibration decreases. The main constraint being the ability of a servo valve to deliver hydraulic fluid efficiently as the commanded frequency is increased. Most large size servo valves start to lose fluid delivery efficiency around 100 Hz. Obviously, the other constraint is the ability of the hydraulic power unit and hoses and drilled passages such as those in the manifold block and the passages drilled in the reaction mass, to supply hydraulic fluid with a minimum of pressure drop.

Thus, to drive a pile using the present invention the following steps are to be followed:

1. The hydraulic power unit 6 is started and high pressure hydraulic fluid is supplied thru the delivery hose 6a to servo valve 29a thru manifold block 29c.
2. Pile 9 is placed between pile gripper jaws 23a and the gripper jaw piston (not shown). The clamping assembly is pressurized by controls and hoses (not shown), to clamp the pile in place in line with the axis of the linear vibratory pile driver 10.
3. Pile 9 with pile driver apparatus 10 is lowered by crane 2 to the point where the weight of the pile driver and the pile are bearing on the ground (the pile and pile driver may be guided by the use of "leads" which attached to can hold in proper position guide the pile driver and pile to the specific place where the pile is to be driven.) or the pile may be locked into engagement with a previously driven pile as is the practice when driving "sheet" pilings which are used for building either permanent or temporary retaining walls. Sometimes piles are "started" by carefully positioning the pile and driver at the spot where the pile is to be driven and skillfully lowered as the vibratory is turned on and lowered slowly until the pile has penetrated the ground sufficiently enough so that it will stand on its own, then the crane may slack the hoisting cable and allow the full weight of the pile driver to bear on the top of the pile, this facilitating the driving of the pile as the vibratory is turned up to full power.

4. Once pile 9 has started to be driven by linear vibratory driver 10, the operator may "tune" the apparatus to the most desirable frequency for speed of driving by manually adjusting the frequency control settings on the electronic control unit to the point where he observes that the pile is being driven fastest. Once he sets the control unit at a given frequency, it will stay there unless he changes the adjustment. In places where it is unsafe to use certain frequencies of vibration, for instance where they might cause damage to a structure or even be a nuisance, the electronic control unit may be set to specifically exclude those frequencies, and the operator may then use either above or below the critical frequencies.

5. Electronic control unit 30 may be programmed to either exclude certain frequencies or not, but also it may be set up to sense the rate of driving by the use of an accelerometer attached to apparatus 10, by which it will automatically seek the frequencies which will drive the pile at the fastest rate for the given driving site. The electronic control unit may also monitor the vibrations being transmitted through the ground from the pile being driven, utilizing ground implanted accelerometer 8. If the vibrations reach a level deemed to be harmful to nearby structures for instance, the control unit may automatically turn the pile driver to a frequency which does not shake the ground as much. The electronic control unit may be programmed to integrate the input from the accelerometer transducer attached to the pile driver which monitors driving speed and frequency, as well as the ground implanted accelerometer transducer which monitors frequency and amplitude of the vibrations being transmitted through the ground using the data from both transducers, the monitor can automatically seek the best driving frequency and at the same time make sure that no unwanted frequency amplitudes are emanating from the pile driving site.

FIG. 6 illustrates pile driver 10 connected to a crane 2 by hoisting cable 3. As discussed above, hoisting cable 3 is attachable to the lifting bale which is attachable to lifting shaft 12. The hydraulic power unit 6 is connected to pile driver 10 by hydraulic power supply and return lines *6a*. Means for operator control 30 (control box 30) of driver 10 is shown to include as inputs, a vibration sensing transducer 7 affixed to pile driver 10 and a vibration sensing transducer 8 implanted in ground 5. Control cables communicate the control signal from control box 30 to means 29 for frequency controlling the vibration of driver 10.

It is also thought that linear vibratory pile driver 10 and its use, and manner of use and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A linear vibratory pile driver apparatus to drive and to pull pilings comprising:

a lifting shaft vibration isolated from, but slideably mounted within, a piston assembly, said piston assembly attached to a frame assembly, said frame assembly restricting sliding movement of said lifting shaft within said piston assembly;

means for vibration isolating said lifting shaft from said piston assembly;

a cylinder assembly attached to a reaction mass, said piston assembly vibratorily positioned within said cylinder assembly; and means for vibratorily driving said piston assembly, by hydraulic fluid, at a selectable frequency thereby vibrating said piston assembly and said attached frame assembly relative to said cylinder assembly attached to said reaction mass assembly.

2. A linear vibratory pile driver having a cable-end and a clamp-end thereof comprising:

a lifting shaft having a cable-end and a clamp-end, said lifting shaft adaptable for attaching and suspending said pile driver, at said cable-end, to a cable;

means for vibration isolating said cable from vibration of said pile driver, said means for isolating also limiting movement of said lifting shaft relative to a vibratory assembly;

said vibratory assembly comprising:

a piston assembled and positioned concentrically around and in sliding association with said lifting shaft;

a piston ring member extending radially from an outer surface of said piston;

a frame assembly rigidly affixed to said piston, said frame assembly having a frame cable-end member, a frame clamp-end member and at least one frame connecting member connecting said cable-end member and said clamp-end member, said cable-end member and said clamp-end member each cooperating with said means for isolating said cable and each configured to limit sliding movement of said lifting shaft, said frame clamp-end attachable to said means for clamping;

a reaction mass having a cylinder wall member configured and assembled concentrically around and in sliding association with said piston, said cylinder wall member to define, in combination with said piston and said piston ring member a cylinder head cavity having a cylinder head cable-end cavity and a cylinder head clamp-end cavity;

said linear vibratory pile driver further comprising:

means for providing fluid into said cylinder head cavity; and means for relative pressurizing at a determined and controlled frequency, each said cylinder head cable-end cavity and said cylinder head clamp-end cavity relative each to the other.

3. The linear vibratory pile driver according to claim 2 further comprising a plurality of means for fluid-tight sealing of said fluid within said cylinder head cavity between said sliding association of said cylinder wall member and said piston.

4. The linear vibratory pile driver according to claim 2 further comprising a plurality of cylinder wall member bearing devices to make substantially frictionless said sliding association of said cylinder wall member and said piston.

5. The linear vibratory pile driver according to claim 3 further comprising a plurality of cylinder wall member bearing devices to make substantially frictionless said sliding association of said cylinder wall member and said piston.

6. The linear vibratory pile driver according to claim 2 further comprising a plurality of lifting shaft bearing devices to make substantially frictionless said sliding association of said piston with said lifting shaft.

7. The linear vibratory pile driver according to claim 3 further comprising a plurality of lifting shaft bearing devices to make substantially frictionless said sliding association of said piston with said lifting shaft.

8. The linear vibratory pile driver according to claim 5 further comprising a plurality of lifting shaft beating devices to make substantially frictionless said sliding association of said piston with said lifting shaft.

9. The linear vibratory pile driver according to claim 2 wherein said means for relative pressurizing at a determined and controlled frequency is a spool valve having a valve spool member, said linear vibratory pile driver further comprising means for indicating a position of said valve spool member within said spool valve.

10. The linear vibratory pile driver according to claim 5 wherein said means for relative pressurizing at a determined and controlled frequency is a spool valve having a valve spool member, said linear vibratory pile driver further comprising means for indicating a position of said valve spool member within said spool valve.

11. The linear vibratory pile driver according to claim 8 wherein said means for relative pressurizing at a determined and controlled frequency is a spool valve having a valve spool member and a spool controller, said linear vibratory pile driver further comprising means for indicating a position of said valve spool member within said spool valve.

12. The linear vibratory pile driver according to claim 2 further comprising means for determining location of said reaction mass relative to said frame assembly.

13. The linear vibratory pile driver according to claim 11 further comprising means for determining location of said reaction mass relative to said frame assembly.

14. The linear vibratory pile driver according to claim 5 further comprising;

means for controllably varying said determined and controlled frequency of said relative pressurizing; and means for controlling a magnitude of pressure of said fluid into said cylinder head cavity.

15. The linear vibratory pile driver according to claim 8 further comprising;

means for controllably varying said determined and controlled frequency of said relative pressurizing; and means for controlling a magnitude of pressure of said fluid into said cylinder head cavity.

16. The linear vibratory pile driver according to claim 11 further comprising;

means for controllably varying said determined and controlled frequency of said relative pressurizing; and means for controlling a magnitude of pressure of said fluid into said cylinder head cavity.

17. The linear vibratory pile driver according to claim 13 further comprising;

means for controllably varying said determined and controlled frequency of said relative pressurizing; and means for controlling a magnitude of pressure of said fluid into said cylinder head cavity.

18. The linear vibratory pile driver according to claim 15 wherein said piston ring member extends radially from an outer surface of said piston and is substantially at an axial mid-point of said piston, wherein said means for isolating is at least one device selected from the group consisting of springs, dished washers, and elastomers; and wherein said means for providing fluid into said cylinder head cavity comprises:

at least one cable-end fluid port in fluid flow communication with said cylinder head cable-end cavity and in fluid flow communication with at least one first fluid channel;

at least one clamp-end fluid port in fluid flow communication with said cylinder head clamp-end cavity and in fluid flow communication with at least one second fluid channel, said means for relative pressurizing at a determined and controlled frequency, each said cylinder head cable-end cavity and said cylinder head clamp-end cavity relative each to the other comprises a spool valve having a valve spool member and a spool controller;

a manifold block positioned adjacent to said spool valve to provide the proper porting configuration between each said at least one fluid channel and each said at least one second fluid channel;

at least one bumper fixedly attached to said frame clamp-end member;

at least one bumper fixedly attached to said frame cable-end member for protecting said frame assembly from said reaction mass; and a bumper disposed between said lifting shaft clamp end and said frame clamp-end member.

19. A method of driving a pile using a linear vibratory pile driver, comprising the steps of:

attaching and suspending, at a cable-end, said linear vibratory pile driver to a cable of a crane;

clamping a pile between gripper jaws at a clamp-end of said pile driver;

placing said pile where it is to be driven;

providing means for isolating said cable from vibration of said pile driver;

imparting linear vibration to said pile, at said clamp-end, by means of a vibratory assembly, said vibratory assembly comprising:

a piston portion positioned concentrically around and in sliding association with a means for attaching and suspending said pile driver, said piston portion having a piston ring member;

a frame portion rigidly affixed to said piston portion, said frame portion having a cable-end member, a clamp-end member and at least one connecting member connecting said cable-end member and said clamp-end member, said cable-end member and said clamp-end member each cooperating with said means for isolating said cable and each configured to limit sliding movement of said means for attaching and suspending, said clamp-end attachable to said means for clamping;

a reaction mass positioned concentrically around and in sliding association with said piston portion, said reaction mass having a cylinder wall member configured to define, in combination with said piston portion, said piston ring member a cylinder head cavity having a cylinder head cable-end cavity and a cylinder head clamp-end cavity, each said cable-end cavity and said clamp-end cavity in fluid flow communication with a source of pressurized fluid and a means for cyclically providing each said cylinder head cable-end cavity and said cylinder head clamp-end cavity with said pressurized fluid;

providing said pressurized fluid into said cylinder head cavity; and relative pressurizing, cyclically at a predetermined frequency, each said cylinder head cable-end cavity and said cylinder head clamp-end cavity;

controlling frequency of said relative pressurizing; and controlling magnitude of relative pressure independent of said controlled frequency and without effecting said controlled frequency.

20. The method of claim 19 further comprising the steps of:

implanting at least one transducer in the ground; and controlling the frequency of the vibration of the pile by integrating, in an electronic control unit, the output from said at least one transducer implanted in the ground and the output from said at least one transducer attached to the pile driver.

* * * * *